US007665618B2

(12) United States Patent
Jay et al.

(10) Patent No.: US 7,665,618 B2
(45) Date of Patent: Feb. 23, 2010

(54) PRODUCT DISPENSER TRACK ASSEMBLY

(76) Inventors: Richard Jay, 53 Compo Beach Rd., Westport, CT (US) 06880; Raymond Schneider, 71 Sintsink Dr. East, Port Washington, NY (US) 11050

( * ) Notice: Subject to any disclaimer, the term of this patent is extended or adjusted under 35 U.S.C. 154(b) by 416 days.

(21) Appl. No.: 11/098,123

(22) Filed: Apr. 4, 2005

(65) Prior Publication Data

US 2006/0196840 A1 Sep. 7, 2006

Related U.S. Application Data

(60) Provisional application No. 60/657,570, filed on Mar. 1, 2005.

(51) Int. Cl.
*A47F 1/04* (2006.01)

(52) U.S. Cl. ..... 211/59.2; 211/59.4

(58) Field of Classification Search ..... 211/59.2, 211/49.1, 59.4, 63, 13.1, 90.02, 187, 184, 211/59.3; 221/64, 66, 72
See application file for complete search history.

(56) References Cited

U.S. PATENT DOCUMENTS

| | | | | | |
|---|---|---|---|---|---|
| 1,993,451 | A | * | 3/1935 | Michaud | 221/311 |
| 2,353,394 | A | * | 7/1944 | Farmer | 211/59.2 |
| 2,442,025 | A | * | 5/1948 | Smith | 193/17 |
| 2,818,978 | A | * | 1/1958 | Post | 211/59.2 |
| 3,753,507 | A | | 8/1973 | James et al. | |
| 4,105,126 | A | * | 8/1978 | Deffner et al. | 211/59.2 |
| D285,774 | S | * | 9/1986 | MacLaughlin | D9/777 |
| 5,570,811 | A | * | 11/1996 | Wittern et al. | 221/127 |
| 5,645,176 | A | | 7/1997 | Jay | |
| 5,685,664 | A | * | 11/1997 | Parham et al. | 403/393 |
| 5,695,075 | A | * | 12/1997 | Flum et al. | 211/59.2 |
| 5,695,076 | A | | 12/1997 | Jay | |
| 5,695,077 | A | | 12/1997 | Jay | |
| D393,550 | S | | 4/1998 | Jay | |
| D401,436 | S | | 11/1998 | Jay | |
| D402,829 | S | | 12/1998 | Jay | |
| 5,865,324 | A | | 2/1999 | Jay et al. | |
| 5,975,318 | A | | 11/1999 | Jay | |
| D426,092 | S | | 6/2000 | Neustadt | |
| 6,105,791 | A | | 8/2000 | Chalsen et al. | |
| 6,189,734 | B1 | * | 2/2001 | Apps et al. | 221/193 |
| D450,726 | S | | 11/2001 | Menz | |

(Continued)

OTHER PUBLICATIONS

International Search Report (PCT/US06/07276), Aug. 15, 2007.

*Primary Examiner*—David Purol
(74) *Attorney, Agent, or Firm*—Carter, DeLuca, Farrell & Schmidt, LLP

(57) ABSTRACT

An improved gravity feed product dispenser track apparatus for products sold in containers having a truncated conical shape, such as a bell shape or an inverted bell shape used for certain popular yogurt products. The dispenser track assembly of the present disclosure aligns the products on a track with a front discharge portion and an exit ramp that tilts the lead product forward or rearward so that the inclined or declined front surface of the container is pivoted to a more vertical state to improve its visibility for customers. A plurality of pull through fingers is disposed near front discharge portion. These fingers maintain a lead container on the track while also allowing a customer to remove a container by pulling it through the opening between the fingers.

9 Claims, 19 Drawing Sheets

U.S. PATENT DOCUMENTS 6,325,221 B2 * 12/2001 Parham ..... 211/59.2
D459,738 S 7/2002 Menz
6,502,408 B1 1/2003 Corcoran
6,604,638 B1 8/2003 Primiano et al.
6,637,604 B1 * 10/2003 Jay ..... 211/59.2
6,722,509 B1 4/2004 Robertson et al.
6,874,646 B2 4/2005 Jay
2003/0132178 A1 7/2003 Jay et al.

* cited by examiner

PRODUCT DISPENSER TRACK ASSEMBLY

The present application claims priority to U.S. Provisional Patent Application Ser. No. 60/657,570 filed on Mar. 1, 2005. The entire contents of these applications are incorporated herein by reference.

BACKGROUND OF THE INVENTION

This disclosure is in the field of product dispensers where aligned products slide along a track to a discharge portion of the track, the products being dispensed or positioned to be removed one at a time beginning with the lead product. This disclosure is particularly related to product dispensers having gravity feed tracks for guiding products whose front wall surface bears product identifying information for customers to see.

PRIOR ART

In the field of product dispensers there are numerous apparatus having tracks on which products are aligned and slide forward to a front discharge portion, where a customer can manually remove the exposed lead product. The shapes of such dispensed products vary greatly, including common rectangular boxes, round cylinders and a vast number of irregular shapes, and also truncated cones with flat horizontal tops and bottoms, some tapered to a smaller diameter at the top in a bell shape and some tapered to a smaller diameter at the bottom in an inverted bell shape. These two upward tapered and downward tapered truncated cone shapes are commonly used for containers for certain popular brands of yogurt.

When yogurt containers as described above are allowed or are directed to slide on a downward inclined dispenser track, two kinds of problems have been recurrent. The first problem concerns poor visibility of the label on the front wall surface of the lead container, which occurs because of the combined inclinations of the tapered wall of the truncated conical shape of the yogurt container and the inclination of the gravity feed track. The ability of customers to quickly find and identify a product is extremely important, whether the customer is seeking a particular product or whether the seller is displaying and promoting the product. The second problem is misalignment of containers, tangling of one container lid with the adjacent container lid, and/or containers turning and becoming stuck in the track. Any jamming or stoppage of smooth sliding of the products along the track can vary from being a nuisance to being a significant economic problem, where customers cannot easily obtain the products or where store clerks have to return repeatedly to correct the situation. A still further problem is that jammed products remote from the lead product and thus not visible to store clerks can remain on the track so long that they spoil before store clerks are aware that the line of products is jammed.

The present disclosure addresses the above-described problems and provides a new dispenser track assembly, as further described below.

SUMMARY OF THE INVENTION

An improved gravity feed product dispenser track apparatus for products sold in containers having a truncated conical shape, such as a bell shape or an inverted bell shape used for certain popular yogurt products. Such tapered containers have an inclined or declined front surface. The dispenser apparatus of the present disclosure aligns the products on a track with a discharge portion exit ramp that tilts the lead product forward or rearward so that the inclined or declined front surface of the container is pivoted to a more vertical state to improve its visibility for customers.

For bell-shaped containers whose front surface is inclined upward, it is envisioned to employ an exit ramp in combination with a front stop hoop that tilts the lead container forward such that the inclined front surface of the container is pivoted to a more vertical state to improve its visibility for customers and to make the lead container more easily accessible and graspable.

Also disclosed is a multi-tier assembly of product dispenser tracks as described above, where such tracks are vertically spaced apart between a set of side walls.

The present disclosure may also provide a restraining element that automatically bars rearward moving containers from falling off the rear end of the track, while allowing containers to be loaded from the rear onto the track.

It is envisioned that structural connections of the tracks, side walls, front barrier hoop and rear container barrier are also provided, such that no portion protrudes beyond the outer surfaces of the side walls. With such construction, multi-tier dispenser track assemblies can be installed side by side on support shelves and removed in a frontward direction independent of adjacent track assemblies.

A first embodiment of this disclosure includes a dispenser track assembly adapted to hold a plurality of articles, e.g., containers of yogurt, with a lead article at the front of the line, and to dispense the articles or to position the articles one at a time beginning with the lead article to be accessible for removal by a customer, comprising:

a. a track for holding a plurality of articles, the track has a rear end, an opposite front discharge portion, a bottom surface defining a generally flat plane which is downwardly sloped toward the front discharge portion, the bottom surface extends from the rear end to the front discharge portion and is adapted to hold a plurality of articles, and the track is disposed between two side walls; and b. an exit ramp located near the front discharge portion, the exit ramp holds a lead article and tilts the lead article relative to a horizontal plane to better allow a customer to read a label on the lead article. The direction that the exit ramp tilts the lead article depends on the direction of slope on the front of the article. If the front of the article is naturally sloped like a bell-shape, having a rearward or declined slope from the lower portion of the article to the upper portion of the article, the exit ramp will be designed to tilt the article forward, thus having the front face of the article be displayed at an angle that is substantially vertical. If the front of the article is oppositely sloped, like an inverted bell, the exit ramp will be designed to tilt the article rearward, thus having the face of the article be displayed vertically.

In one embodiment, a fence is situated near front discharge portion of the track and adapted to block the lead article from falling forward and off the track. The position and arrangement of the fence allows the lead article to be lifted over the fence and removed from the track.

In another embodiment, a plurality of pull through fingers are provided at a front discharge portion of the track to engage the lead article and to block it from falling forward and off the track. The fingers are sufficiently flexible to permit the lead article to be pulled through an opening between the fingers without the need to lift the article relative to the track. This feature allows the track structure to be stacked one directly above another and thus permits greater product density. In addition, because the fingers only engage the lead article, the flexibility of the fingers can be adjusted to require a consistent extraction force.

A further embodiment of the dispenser track assembly includes a rear restraining element positioned near the rear portion of the track. The rear restraining element prevents an article on the track from falling off the rear of the track. In a particularly useful embodiment, the rear restraining element also enables articles to be inserted onto the track from the rear end.

One type of rear restraining element is an automatic container barrier having a first part which is pivotably engaged with a side wall near the rear portion of the track and a retainer bar which extends from the first part across the track. When an article moves rearward on the track, it contacts the retainer bar. The retainer bar moves above the track, via the pivoting motion of the first part, and prevents the article from falling off the back of the track.

Another type of rear restraining element is a one-way rear gate formed as a living hinge which allows for easy loading. Also, when the gate is contacted by an article sliding rearward, the gate folds over onto the wall of the track and prevents the article from spilling out of the dispenser.

A still further embodiment is a multi-tiered dispenser comprising a plurality of the above-described dispenser track assemblies mounted in a vertically spaced-apart relationship between a set of opposite side walls, forming a single unit.

In an additional embodiment of the dispenser track assembly, the earlier-described exit ramp has a front edge having a central part extending rearward as an open crescent or other shaped notch between two spaced-apart points. This notch facilitates a customer being able to grasp the lead article.

In yet another embodiment the two spaced-apart points of the notch are the forward most parts of the exit ramp and define between them a transverse line over which the lead container tilts forward until it is restrained by a front fence or fingers. In this tilted forward position the front surface or label of the container is readily visible and the lead container is readily graspable by a customer.

In another embodiment, a metering mechanism is provided for use with the fence or plurality of pull through fingers. In one embodiment, the metering mechanism is a set of flippers or pivoting fingers which allow only one article at a time to reach the fence or fingers. In the embodiment with the set of fingers, the metering mechanism further facilitates a constant extraction force and allows a long row of articles to be gravity fed, one at a time, into the shopping area.

Further features and advantages of the disclosure as well as the structure and operation of various embodiments of the present disclosure are described in detail below with reference to the accompanying drawings.

DETAILED DESCRIPTION OF THE INVENTION

Figure 1:
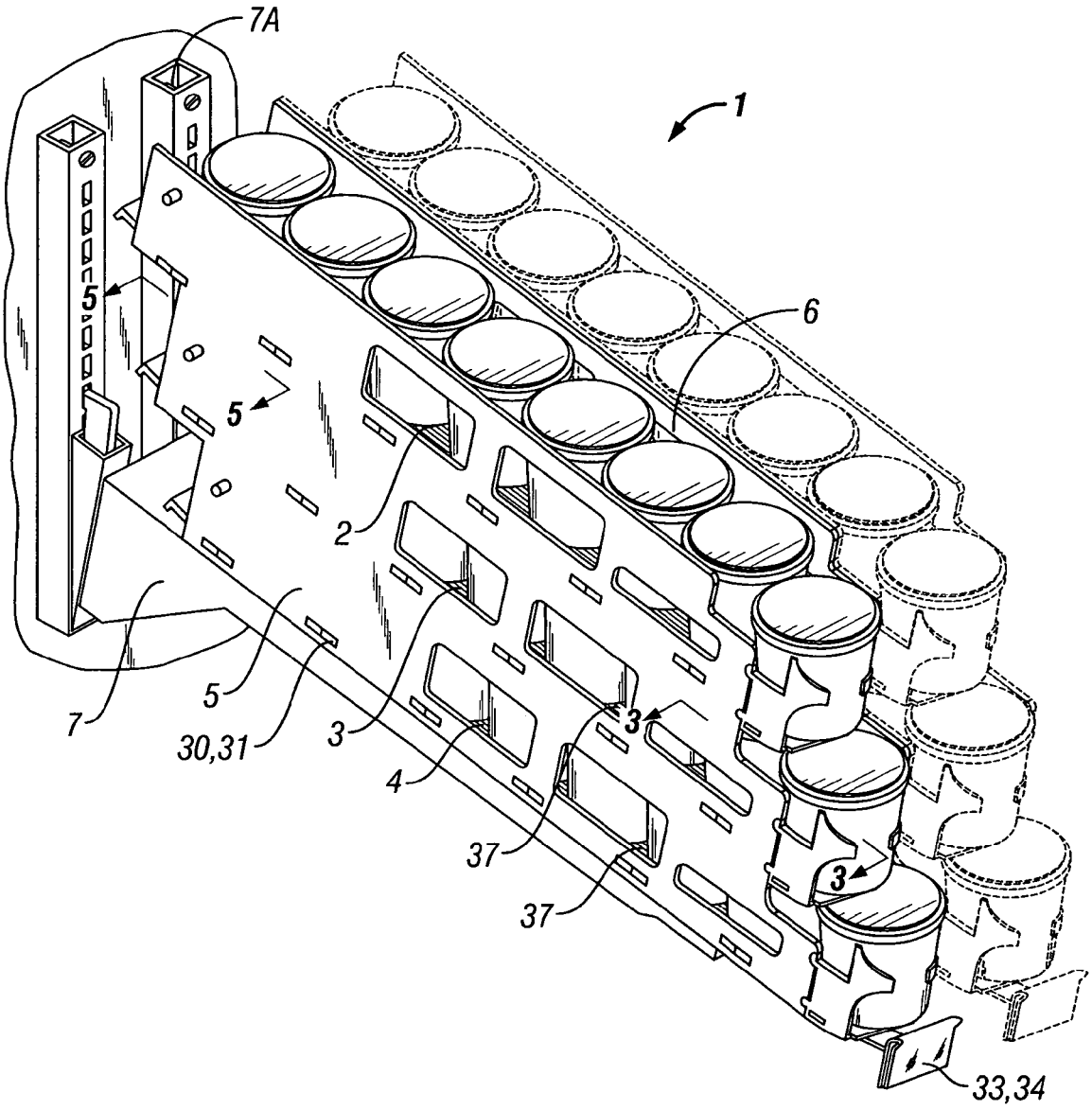
FIG. 1 is a top front perspective view of a first embodiment of a dispenser track assembly loaded with inverted bell-shaped articles.

Two embodiments of the dispenser track assembly are illustrated herein, the first shown in FIGS. 1-11 and second shown in FIGS. 12-17. FIGS. 19-24 illustrate other features of the dispenser track assembly. For convenience and clarity, the same or similar elements in the embodiments will be given the same reference numbers. In the drawings and in the descriptions which follow, the term "proximal," as is traditional, will refer to the end of the dispenser track assembly which is closer to the user, while the term "distal" will refer to the end which is farther from the user.

The first embodiment has been designed to accommodate a product of a particular shape as described below; however, the principles of this product dispenser are applicable for dispensing articles of many other shapes. The products shown in the drawings of the first embodiment are inverted bell-shaped containers corresponding to the containers of a very popular yogurt. When sold in supermarkets and other stores, these containers are commonly stocked in rows extending front-to-rear with only the lead container being clearly visible to customers. Typically, there are additional rows above and below and left and right on multi-level shelves.

Figure 2:
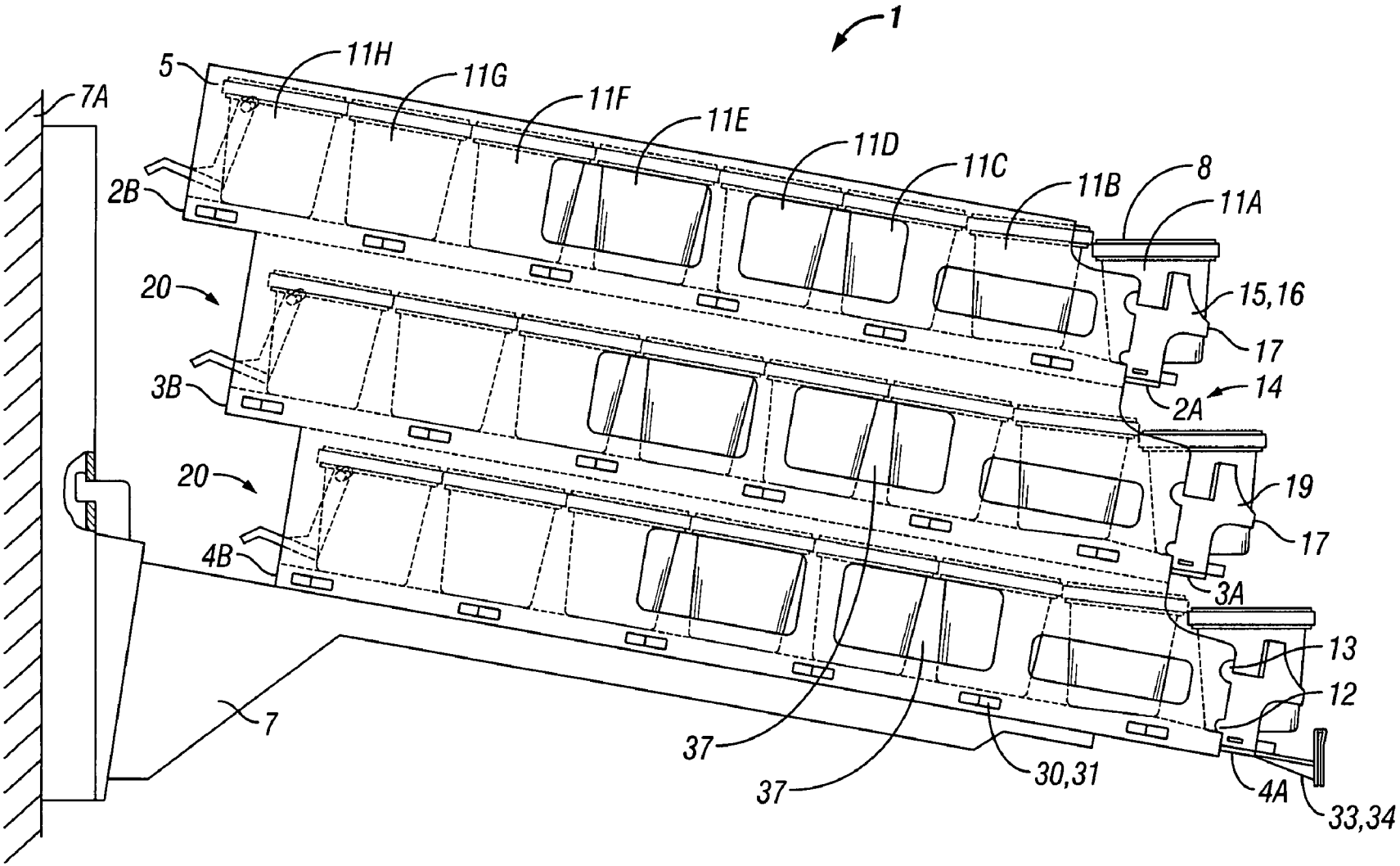
FIG. 2 is a left side elevation view of the dispenser track assembly of FIG. 1, showing rows of food containers situated on three tracks.

FIGS. 1 and 2 show perspective and side elevation views respectively of the first embodiment of the dispenser track assembly generally referred to by reference number 1. This assembly as shown has upper, middle and lower tracks 2, 3 and 4, respectively, with side edges of the tracks 2, 3 and 4 secured to side walls 5 and 6. The number and dimensions of the tracks will vary depending on the size and shape of the articles being dispensed. Each side wall 5 and 6 is a contiguous panel for supporting all the tracks attached thereto. The dispenser track assembly 1 also includes a front discharge portion 2A (for track 2), an exit ramp 9 and a rear end 2B. The dispenser track assembly 1 can be supported and secured on a shelf or can be supported as shown with a cantilever bracket 7 removably attached to a wall or other support 7A. In a particularly useful embodiment, the dispenser track assembly 1, when mounted, will be oriented with the front discharge portion 2A inclined downwardly at an angle in the range of about 5 degrees to about 15 degrees to produce a gravity feed for the articles on the tracks 2, 3 and 4. An alternative arrangement for use with horizontally oriented tracks without gravity feed, uses a mechanical or electrical pusher for urging the articles toward front discharge portions of the tracks (not shown).

For the gravity feed arrangement shown in FIGS. 1 and 2, the principal description herein will be of the upper track 2 and articles thereon, the other tracks 3 and 4 being substantially the same. As noted above, the articles illustrated on track 2 of FIGS. 1 and 2 represent containers of a popular brand of yogurt frequently sold in product dispensers of this type. Each of these containers 11A-11F has an inverted bell shape that is generally flat on the top and the bottom and has a larger diameter top with a downward inclined front surface. As discussed later herein, the dispenser track assembly 1 has significant improvements over conventional dispenser tracks for articles of this inverted bell shape.

Figure 3:
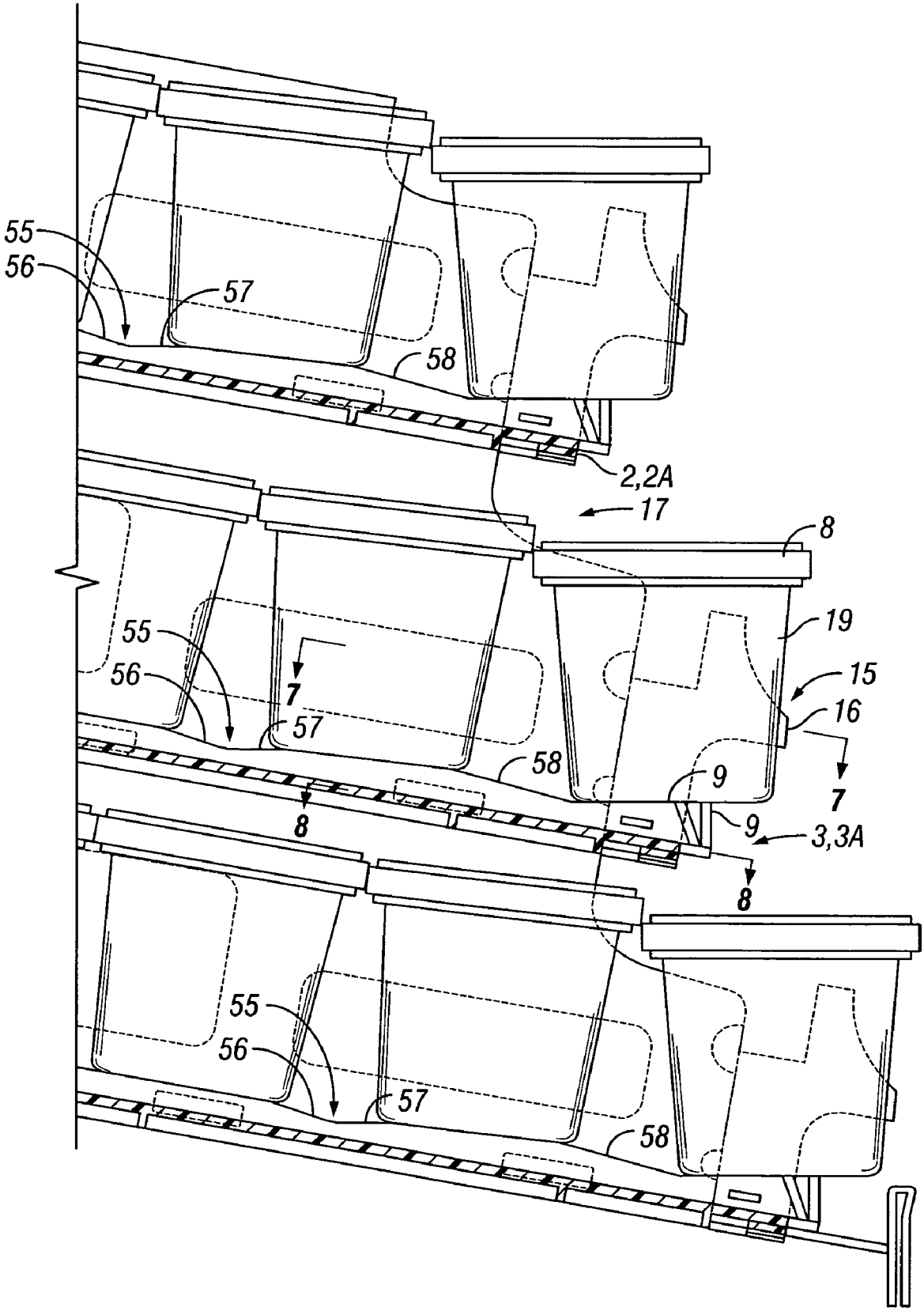
FIG. 3 is a fragmentary enlarged view of a front discharge portion of the dispenser track assembly of FIG. 2, showing tilting of a lead container on an exit ramp of each of the tracks.
Figure 10:
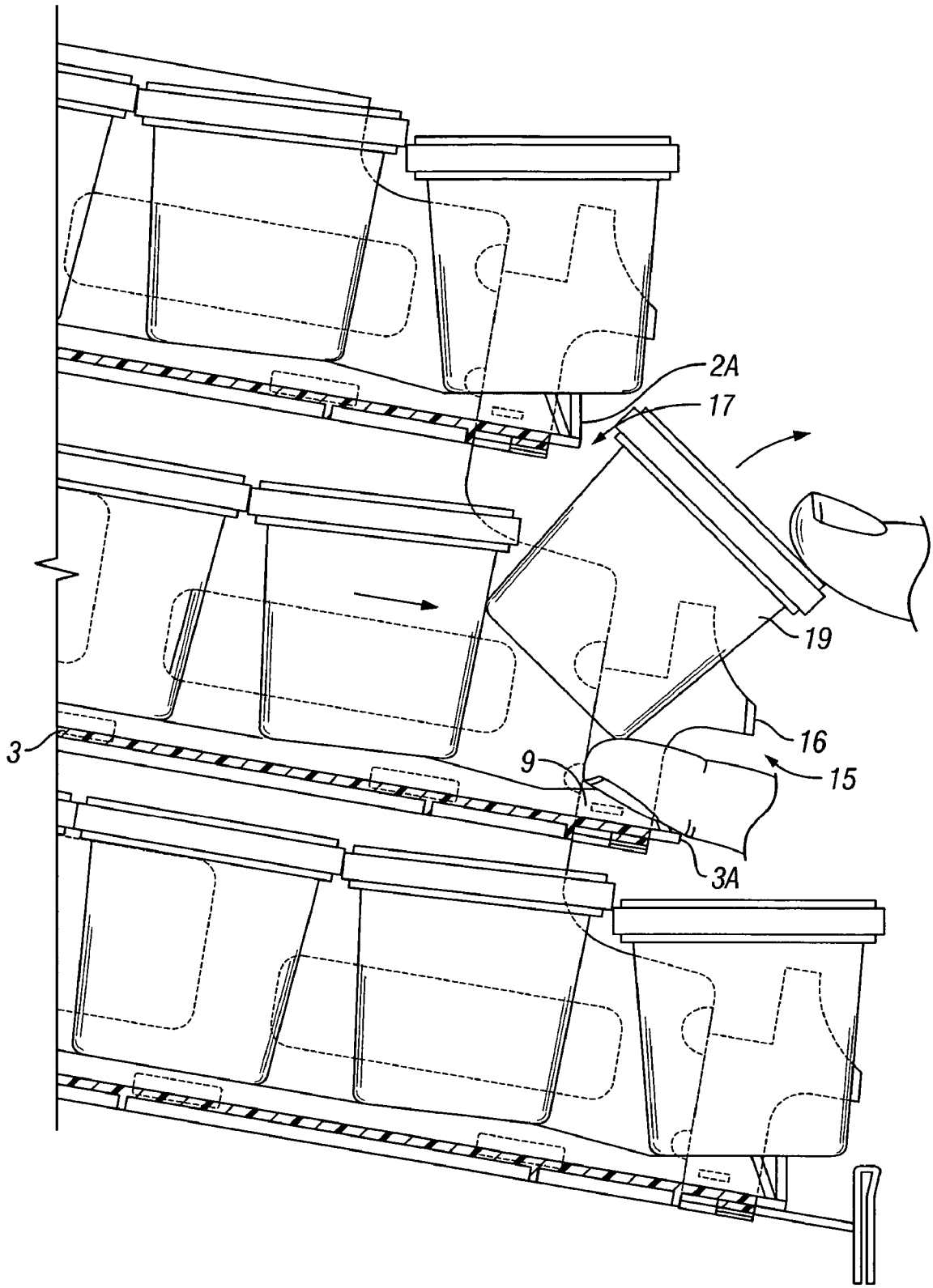
FIG. 10 is a fragmentary side elevation view of the front discharge portion and exit ramp of a track showing removal of the lead container.

As seen in FIGS. 1-3, due to the downward incline, containers 11A-11H (containers generally referred to as numeral 11) aligned on track 2 tend to slide downward toward front discharge portion 2A of track 2, with lid 8 of each container 11 contacting lid 8 of the next adjacent container 11. Lead container 11A at the front discharge portion 2A of track 2 is situated on an upwardly inclined exit ramp 9. In FIGS. 3 and 10 the middle track 3 is more fully depicted than upper track 2, and therefore reference will be made to "middle" track 3 when describing a typical track for which earlier reference has been to "upper" track 2.

As seen in FIGS. 1-3, for these inverted bell-shaped containers 11A-11H, front wall surface of each container 11, except for lead container 11A on exit ramp 9, is inclined downwardly, which renders the label thereon difficult for a customer to easily notice and read. The exit ramp 9 at the front discharge portion 2A of track 2 overcomes the label visibility problem because lead container 11A on exit ramp 9 becomes tilted so that its front surface is tilted upwardly and rearwardly into a generally vertical state. This tilting by the exit ramp 9 compensates for the natural downward incline of the inverted-bell shape and the forward incline of the track 2, thus rendering the label more easily readable by a customer. Quick recognition of the product by customers in supermarkets is important whether the seller hopes to capitalize on impulse purchases or to merely assist the customer in finding what he or she seeks. Additionally, this tilting via exit ramp 9 enables a customer to easily read nutritional information, usually located opposite the label, by turning container 11.

Figure 7:
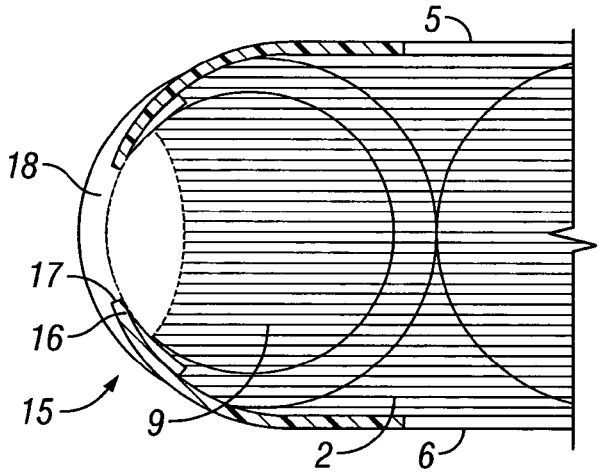
FIG. 7 is a fragmentary top plan view of the front discharge portion of the track, showing a round food container on the exit ramp.
Figure 8:
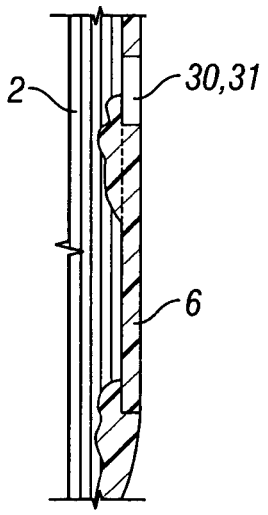
FIG. 8 is a fragmentary sectional view taken along line 8-8 in FIG. 3 showing coupling of the track to a side wall.
Figure 9:
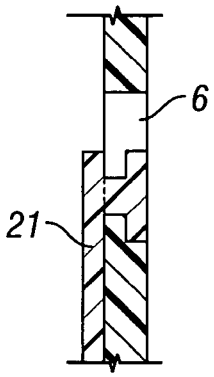
FIG. 9 is a fragmentary sectional view taken along line 9-9 in FIG. 4 showing coupling of a front fence to the side wall of the dispenser track assembly.

The front discharge portion 2A of track 2 includes a fence 15 (also called front stop hoops) formed of a pair of curved fingers 16, each attached to one of side walls 5, 6 and extending forward in a curved manner. As seen in FIG. 7, between tips 17 of fingers 16 is gap 18 providing more visibility for the label and providing access for a customer to more easily grasp and remove lead container 11A. These fingers 16 restrain lead container 11A from falling off the exit ramp 9, but allow the lead container 11A to be tilted forward and lifted off track 2 by a customer (FIG. 10).

Following removal of lead container 11A, the next adjacent container 11B will slide forward into the position previously occupied by lead container 11A.

Figure 11:
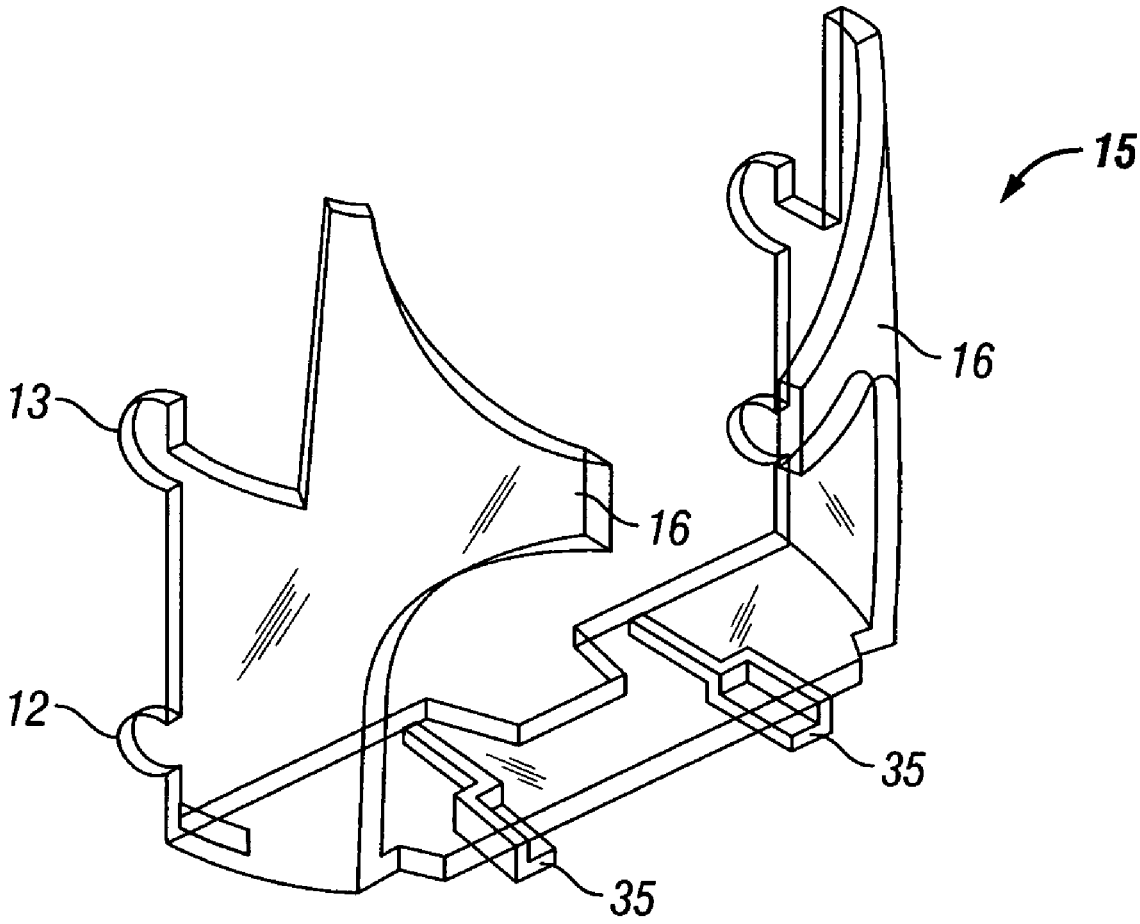
FIG. 11 is a front perspective view of the front fence, which is shown on the tracks in FIG. 1.
Figure 16:
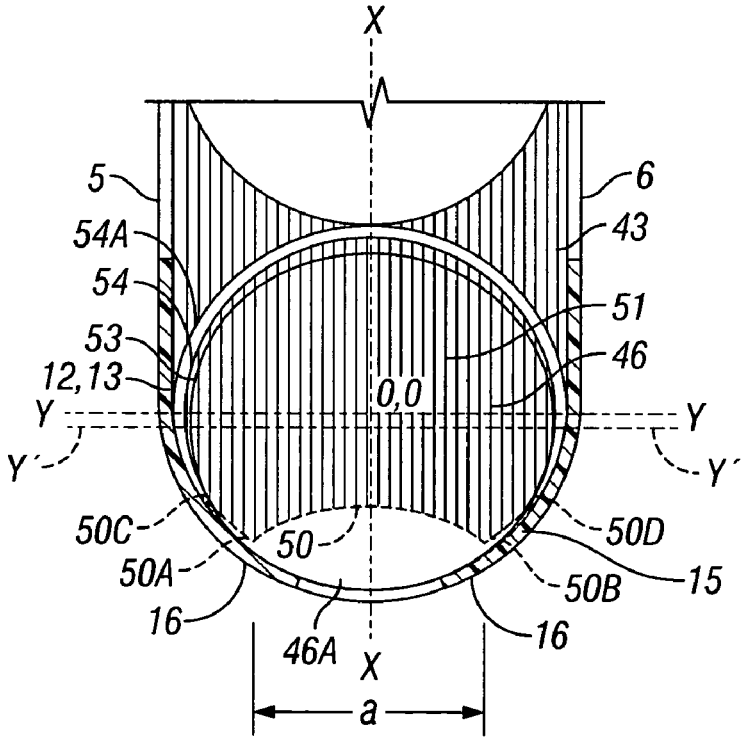
FIG. 16 is a fragmentary top plan view of the exit ramp of a track taken along lines 16-16 in FIG. 14 showing a round food container on the exit ramp.
Figure 17:
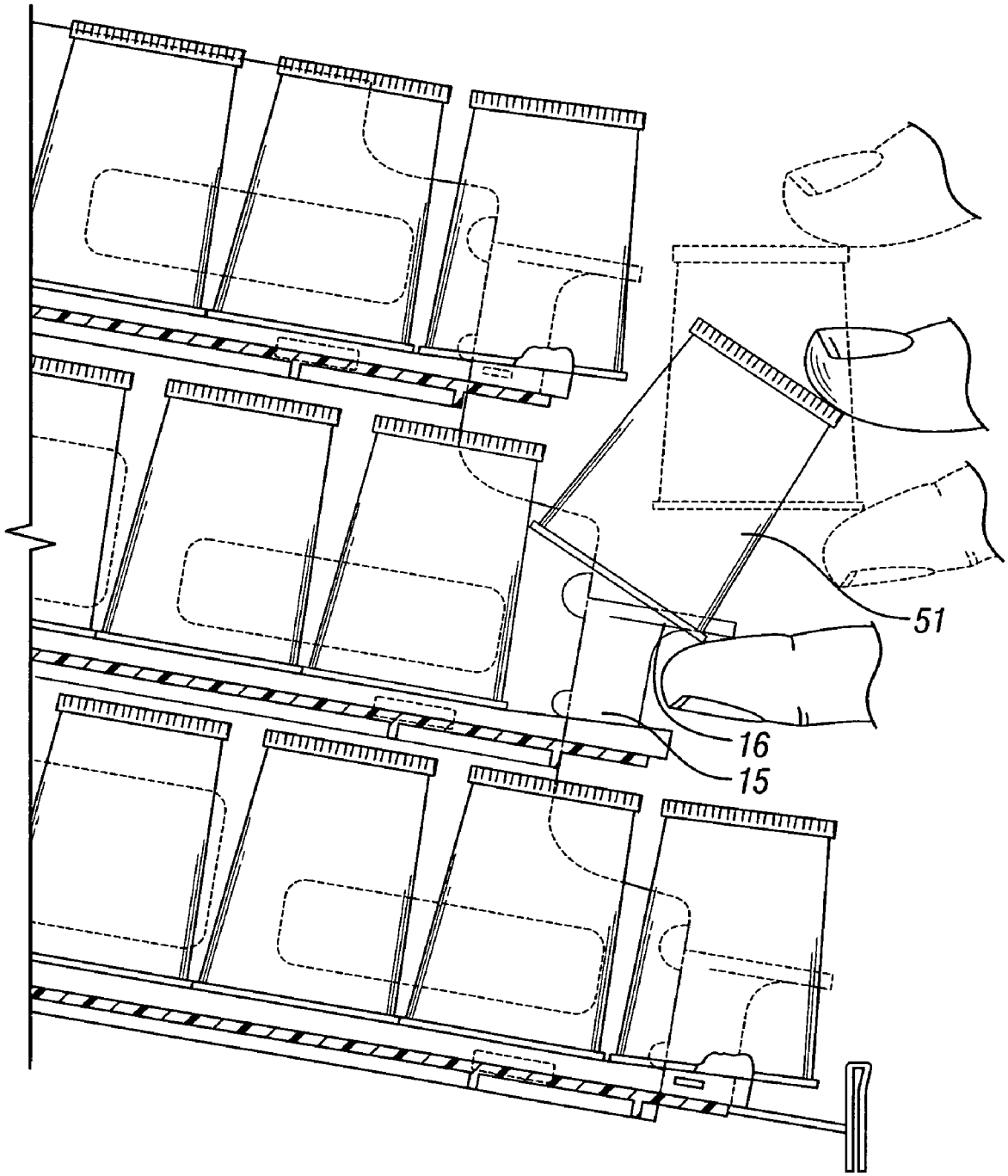
FIG. 17 is a fragmentary side elevation view of the front discharge portion and exit ramp of a track showing removal of the lead container.

As seen in FIGS. 2, 11 and 16 the fence 15 is removably coupled to the track by tabs 12 and 13 which engage corresponding slots in side walls 5 and 6 and do not protrude through these slots beyond outer surface of walls 5 and 6.

As seen in FIGS. 2, 3 and 10, the front discharge portion 2A of the exit ramp 9 of the upper track 2 is displaced slightly rearward of the front edge 3A of the middle track 3. This provides sufficient clearance space 14 above lead container 19 on middle track 3 for container 19 to be lifted upward over its fence 15 without being blocked by the front edge 2A of top track 2. The front edge 3A of the middle track 3 is similarly displaced slightly rearward of the front edge 4A of lower track 4, the result being a cascade appearance of the three front edges 2A, 3A and 4A of the three tracks 2, 3 and 4 respectively. Since the three tracks are substantially the same length to contain a uniform number of containers, their rear ends 2B, 3B and 4B will have an inverted cascade appearance adjacent the vertical wall support 7A.

An automatic container barrier is illustrated in FIGS. 2, 4-6 and 6A at the rear end of each track. This feature comprises back strap 20 formed in a U-shape with arms 21 pivotally connected to side walls 5 and 6. Between arms 21 is a cross bar or retainer bar 22 which is a generally flat strap lying closely adjacent and generally parallel to top surface of track 2 in FIG. 4 and elevated above track 2 in FIGS. 5, 6 and 6A. It is also envisioned for the back strap 20 to be in an L-shape and having only a single arm.

Figure 4:
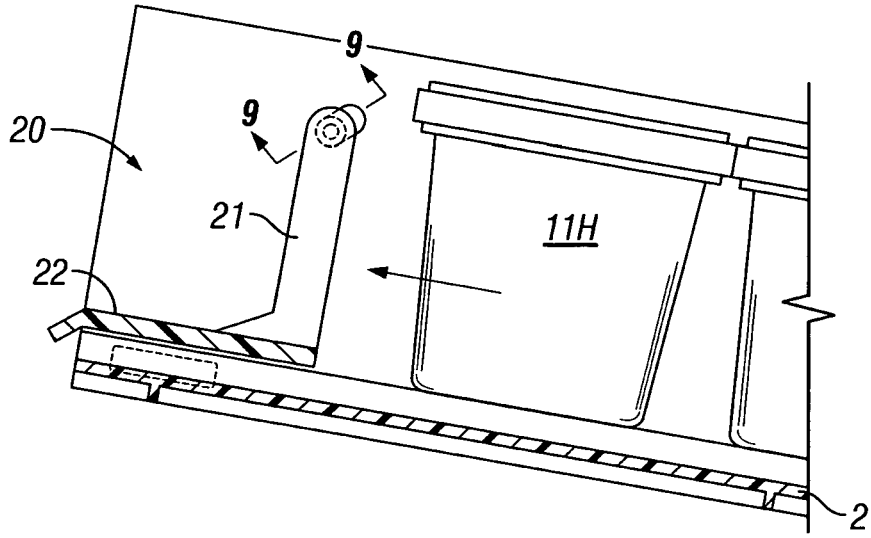
FIG. 4 is a fragmentary side elevation view of a rear portion of the dispenser track assembly with a rear restraining barrier illustrated its down and unpivoted state.
Figure 5:
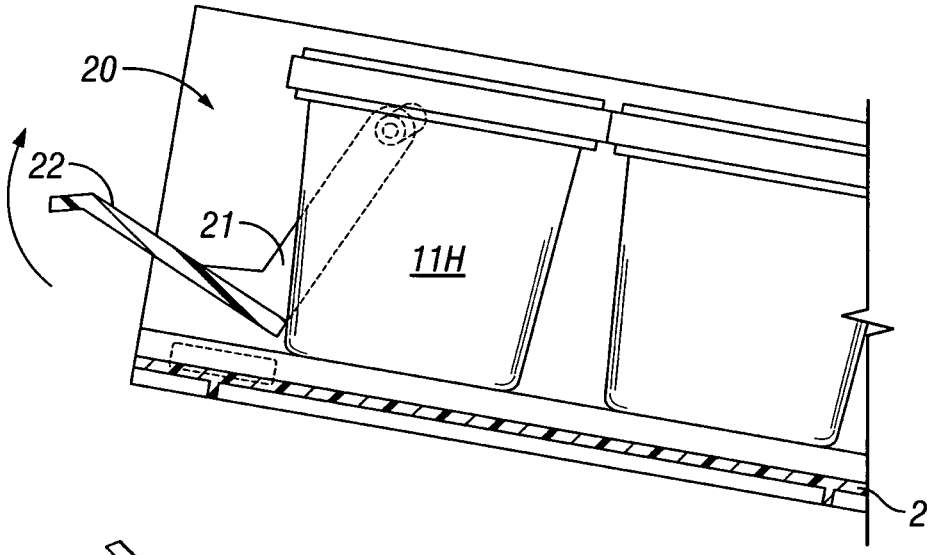
FIG. 5 is a view similar to FIG. 4 showing the rear restraining barrier in its partially pivoted state.
Figure 6:
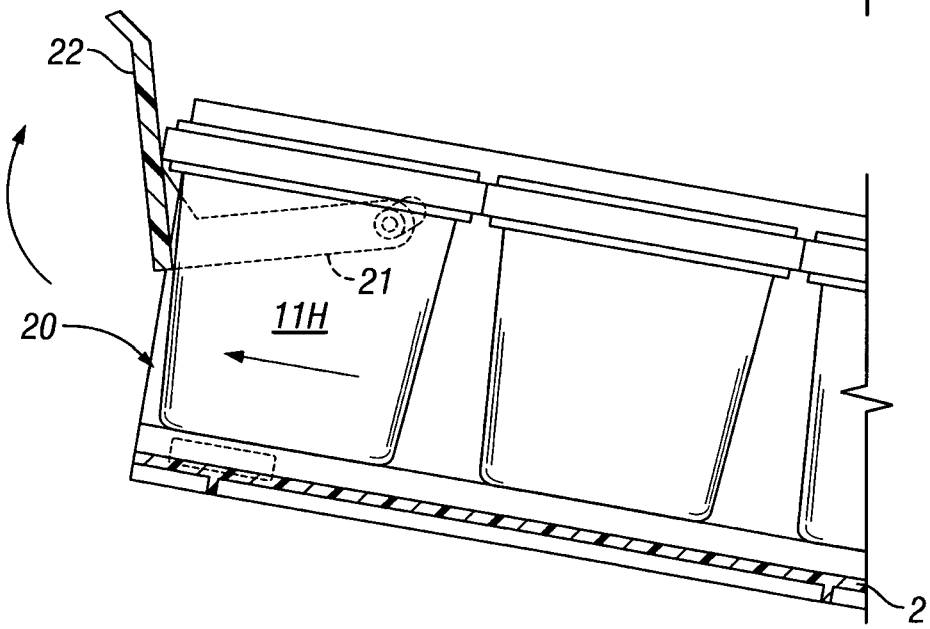
FIG. 6 is a view similar to FIGS. 4 and 5 showing the rear restraining barrier in its up and fully pivoted state where it blocks the rear container from falling rearwardly off the track.
Figure 6A:
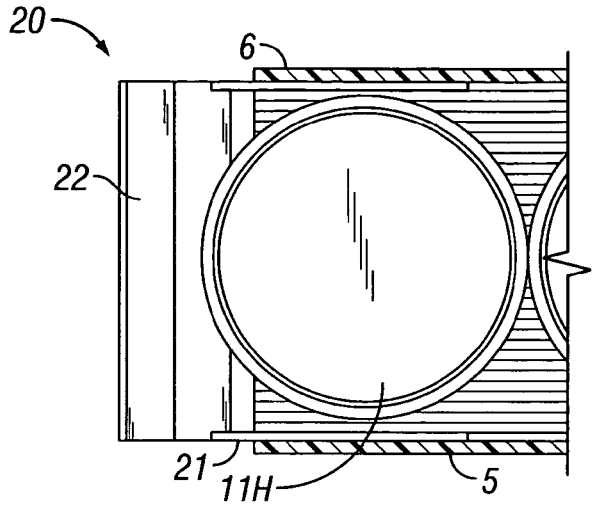
FIG. 6A is a fragmentary top plan view of the rear portion of the track and rear restraining barrier shown in FIG. 6.

The first stage of operation for the automatic container barrier is seen in FIG. 4 where a container 11H moving rearward is about to engage the retainer bar 22 of back strap 20. Further rearward movement of container 11H is seen in FIG. 5, where the rear wall surface of container 11H has engaged and is pushing the retainer bar 22, which has begun to swing rearward and upward. Finally, as seen in FIGS. 6 and 6A, container 11H has pushed or been pushed further rearward, retainer bar 22 has swung as far as it can go in the available arc of the arms 21, and blocks farther rearward movement of container 11H. Since the back strap 20 is freely pivotable, it will swing forward and return to its original position when any or all containers have moved forward and out of contact with retainer bar 22. In its original forward and down position seen in FIG. 4, the back strap 20 will always be ready to engage and restrain a container 11H being pushed rearwardly.

It should be noted that back strap 20, in its initial down position in FIG. 4, has retainer bar 22 generally flat and close to the track's top surface, and arms 21 are spaced-apart and close to side walls 5, 6. Consequently, containers can be loaded from the rear, where each container is pushed between the arms 21, over the retainer bar 22 and onto the track's top surface. This allows optional loading of containers from the front or the rear of the track.

In the embodiment shown in FIGS. 1 and 2, each track 2, 3 and 4 has laterally extending tabs 30 which are inserted into mating slots 31 in the side walls 5 and 6, where the tabs may be permanently or releasably coupled to slots 31. These tabs 30 do not extend beyond the outer surface of side walls 5, 6. Such a configuration allows multiple dispenser track assemblies to be slid into place in a side-by-side relationship or freely removed without disturbing other multi-tiered dispenser track assemblies. Thus, the side walls are coupled to the opposite side edges of each track, and each combination of track plus walls produces an elongated channel in which articles can slide.

As seen in FIGS. 1 and 2, at the front discharge portion of the lower track 4 is a bracket or ticket channel 33 with an internal slot 34 to removably receive a product identification and/or a price label. This bracket 33 is removably mounted in a set of tracks 35 (FIG. 11) in front barrier 15. This bracket 33 also functions as a handle which facilitates pulling the entire assembly in a frontward manner off the supporting shelf to be rear loaded and/or repositioned on the shelf.

As further seen in FIGS. 1 and 2, side walls 5, 6 have a plurality of window-like openings 37 which allow finger access by a clerk to reach into the pathway above a track to align and/or release a container jammed on track 2, 3, 4. These openings 37 also lighten the weight of and reduce the amount of plastic required for side walls 5, 6. The multi-tiered dispenser track assembly 1 is shown in solid line in FIG. 1, with an identical track assembly shown in phantom line immediately adjacent to the right of the solid line dispenser track assembly 1. This demonstrates that one dispenser track assembly can be positioned directly adjacent and against another identical dispenser track assembly and can be easily removed without interference between their outer side surfaces. Smooth and unobstructed outside surfaces are achieved because of the previously described tab-in-slot construction shown (a) in FIG. 8 for coupling of the tracks 2, 3, and 4 to the side walls 5, 6; (b) in FIG. 9 for coupling of the back strap 20 to side walls 5, 6; and (c) in FIG. 16 for coupling fence 15 to side walls 5, 6. In each case a tab enters but does not protrude through the outside surface of any sidewall. The number of side-by-side multi-tier dispenser track assemblies that are used together is variable, and the number of tiers in each multi-tier track assembly is further variable, within space, weight, economical and aesthetic constraints.

Figure 12:
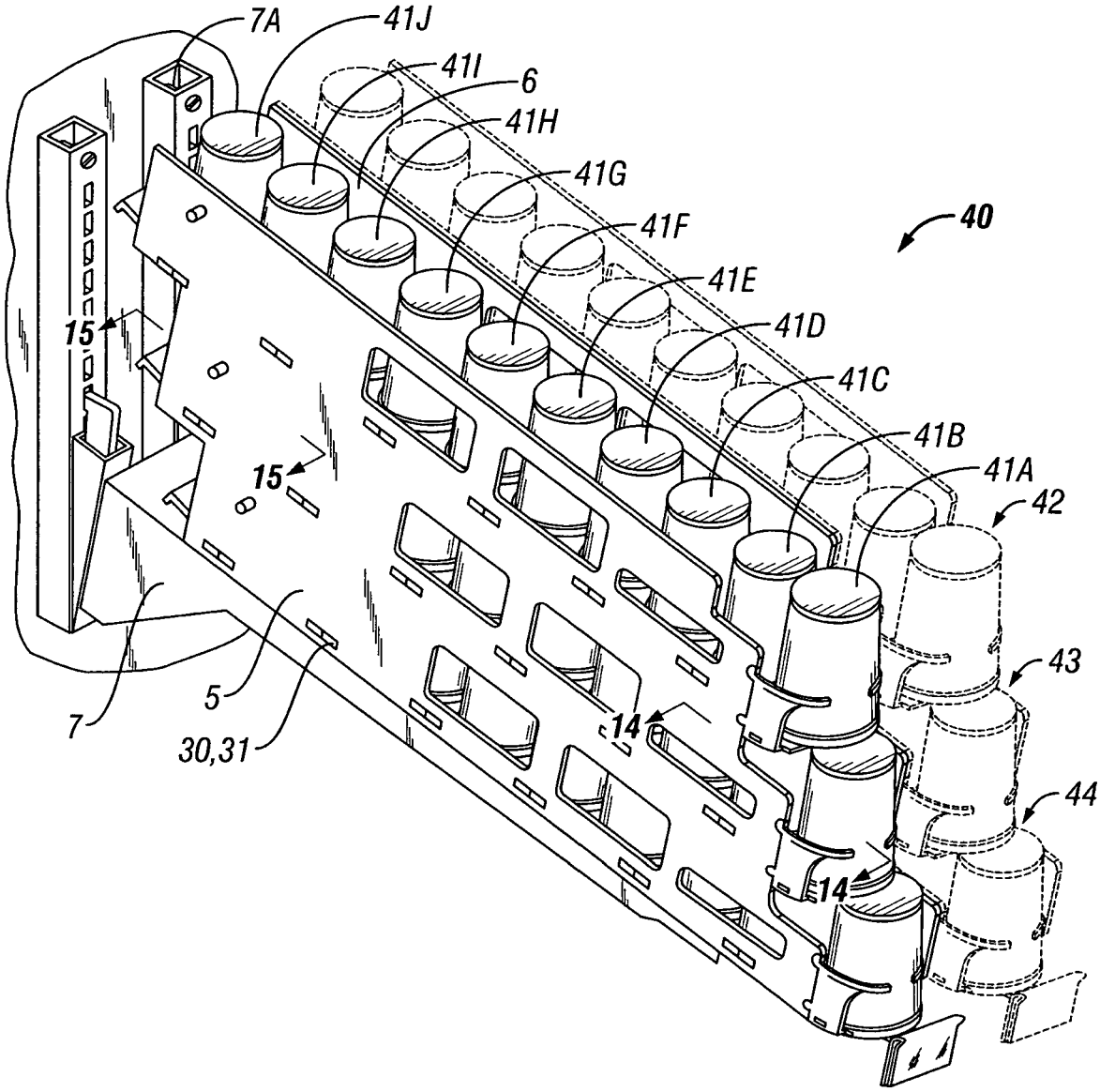
FIG. 12 is a top front perspective view of a second embodiment of the dispenser track assembly loaded with bell-shaped articles, illustrated with a plurality of pull through fingers near the front discharge portion of each track.
Figure 13:
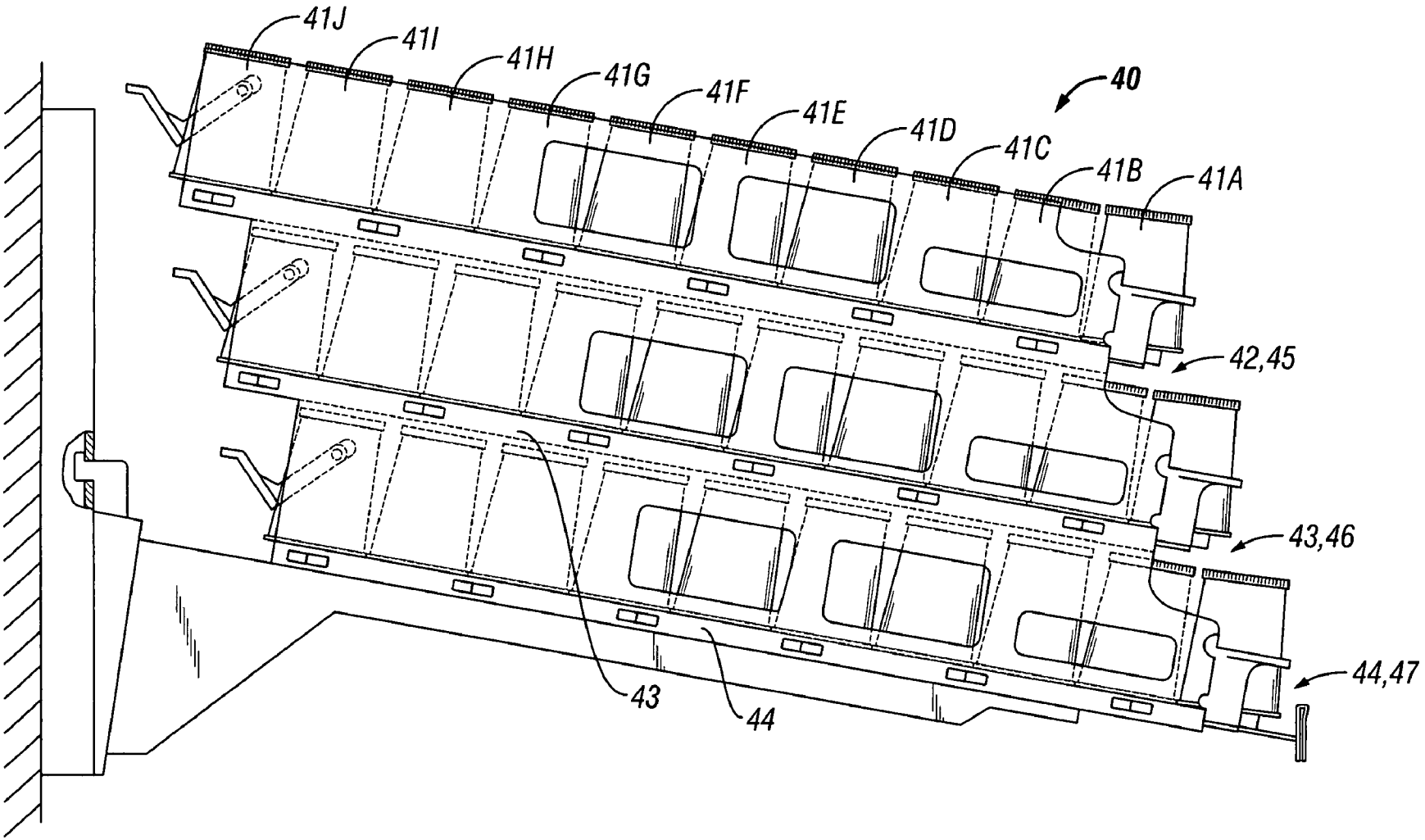
FIG. 13 is a side elevation view of the dispenser track assembly of FIG. 12.

FIGS. 12-17 illustrate a second embodiment 40 of the dispenser track assembly of this disclosure which is similar in part to the first embodiment. As stated earlier, for convenience and clarity, certain elements that are the same in both embodiments will be given the same reference numbers. As shown, dispenser track assembly 40 has upper, middle and lower tracks 42, 43 and 44 respectively coupled to side walls 5 and 6 via tabs 30 of the tracks extending into slots 31 of the side walls. As seen in FIG. 13, at the front discharge portions of tracks 42, 43, 44 are exit ramps 45, 46, 47 respectively. The dispenser track assembly 40 is removably mounted via bracket 7 to rear wall support element 7A.

Further, as seen in FIGS. 12-17, the products being dispensed are containers 41A-41J corresponding to containers used for a very popular yogurt product, which are recognized by their bell shape, having a larger bottom surface than top surface. FIGS. 12 and 13 show containers 41A-41J in a line extending from front to rear on track 42 with container 41A being the lead container situated on exit ramp 45.

FIG. 16 is a fragmentary top plan view of the front discharge portion of track 43 and its exit ramp 46, including central longitudinal axis X-X of track 43. The front discharge portion 46A of exit ramp 46 has a central area "a" defining a crescent recess or notch 50 extending rearwardly between points 50A and 50B. This notch 50 provides easier access for a customer's fingers to grasp the container 51 and better visibility of any label on the front surface of the lead container 51A. The front edge 46A of exit ramp 46 has opposite side areas, extending from points 50A and 50B rearwardly to points 50C and 50D on the side edges of track 43. Circle 53 represents the top edge of container 51. Concentric circles 54 and 54A represent the bottom lip and outer diameter of this lip of container 51. The intersection at point 0, 0 indicates the center of container 41A. A line Y-Y through this center and perpendicular to the central longitudinal axis X-X indicates the location of the center of gravity of container 51. A line Y'-Y', parallel to line Y-Y connects points 50C and 50D, which becomes the line over which container 51 tips forward due to the forces from all the containers behind the lead container 51A trying to slide forward, and because the lead container 51A is poised to tip about a line Y-Y near its own center of gravity.

Figure 14:
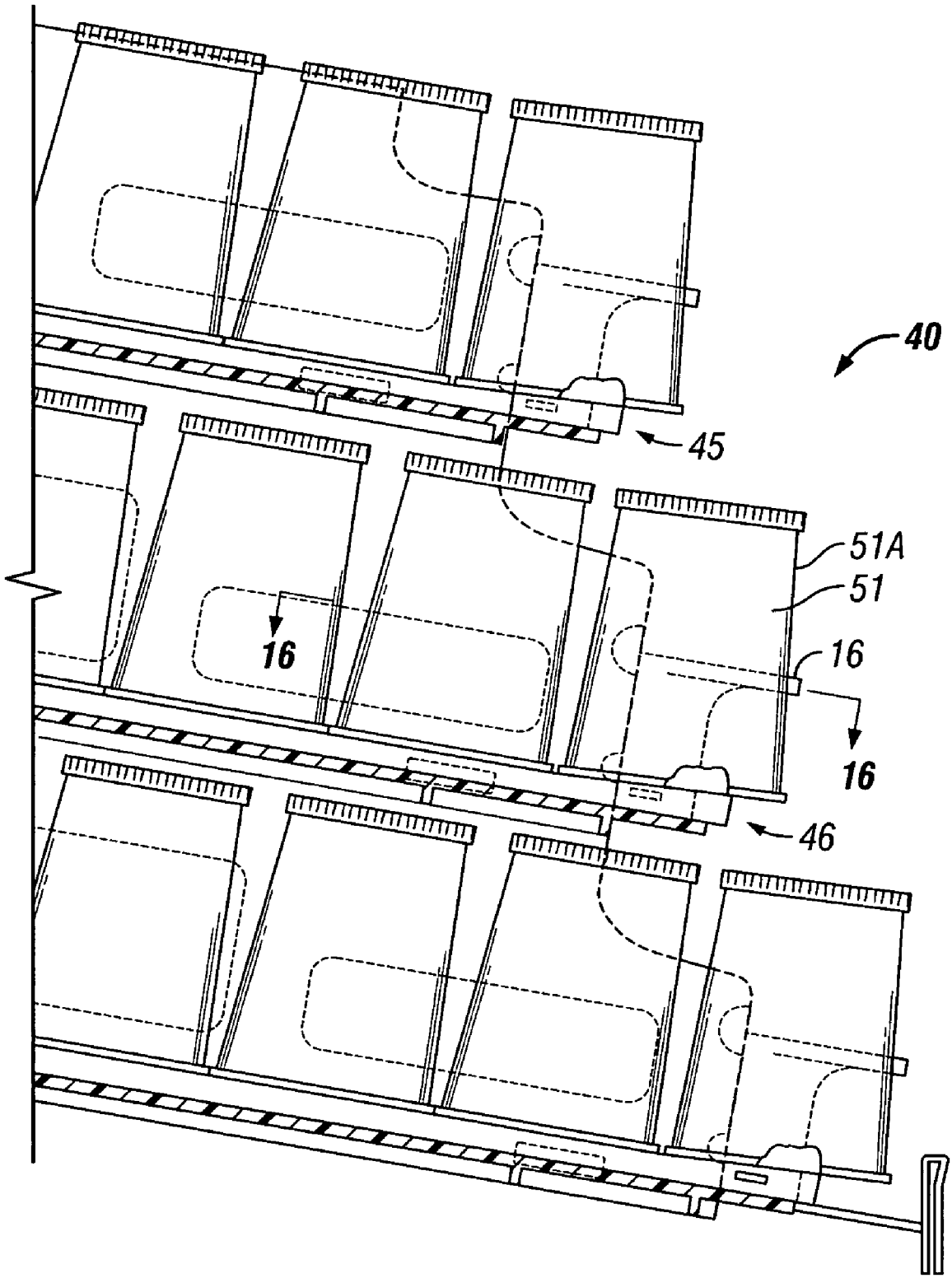
FIG. 14 is a fragmentary enlarged elevation view of the front discharge portion of the dispenser track assembly of FIG. 13 taken along lines 14-14 in FIG. 12.
Figure 18:
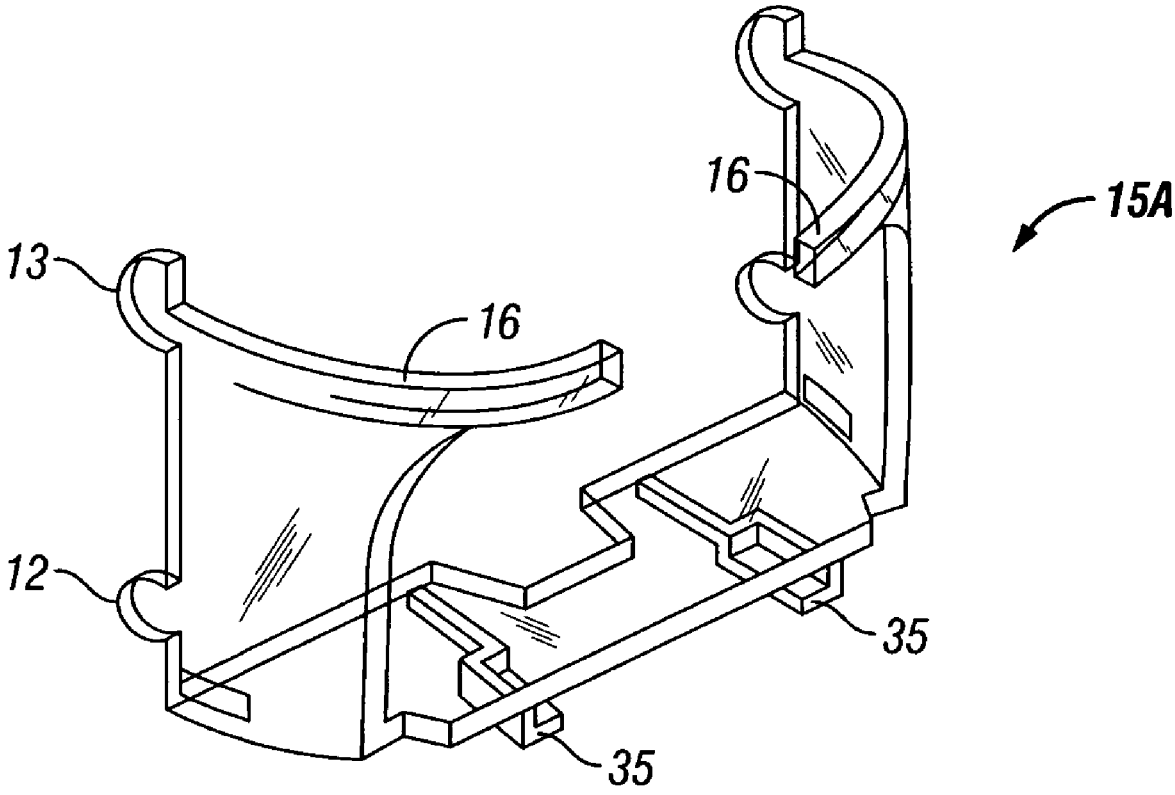
FIG. 18 is a front perspective view of the plurality of pull through fingers, which are shown on the tracks in FIG. 12.
Figure 19:
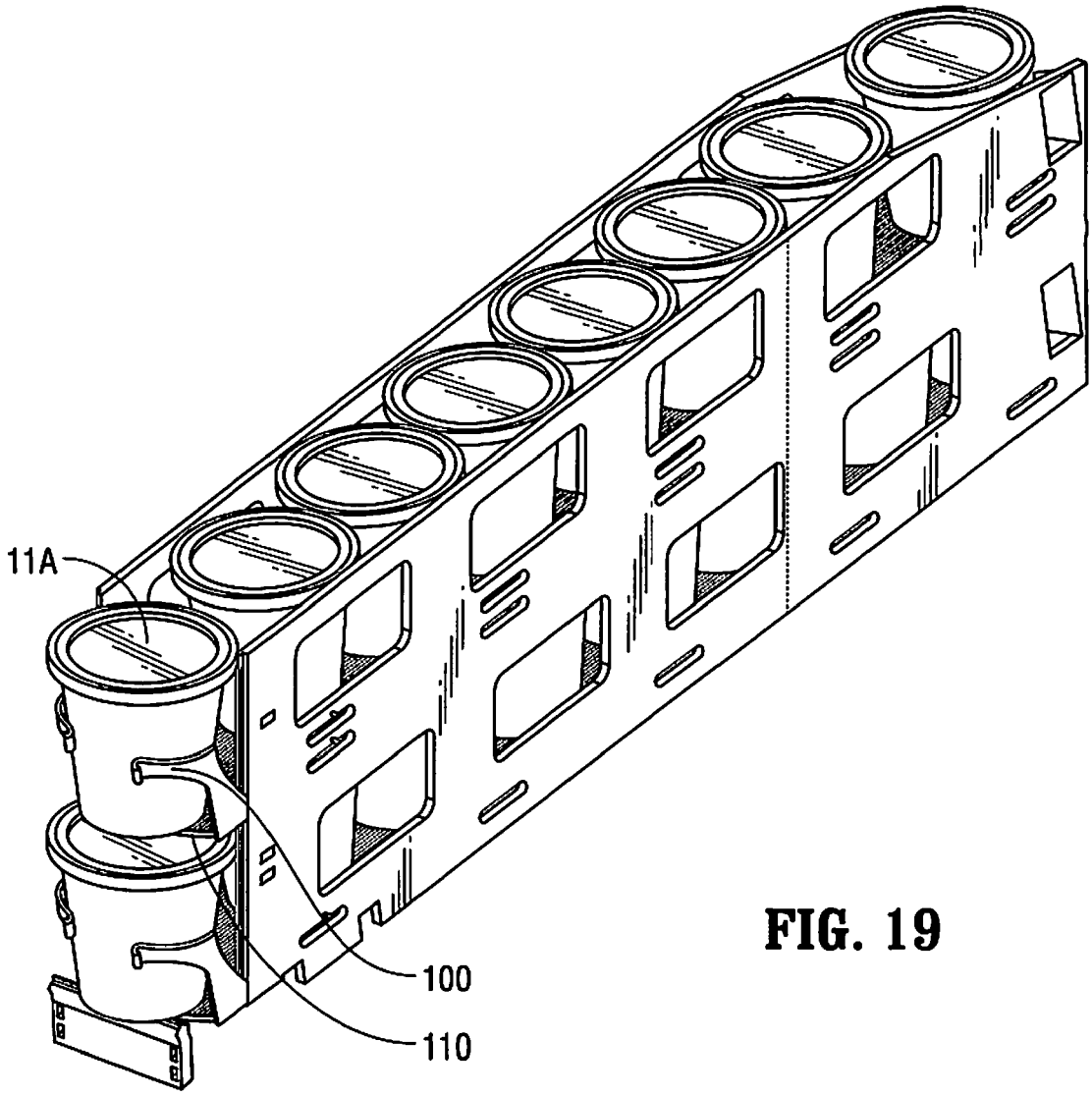
FIG. 19 is a perspective view showing the plurality of pull through fingers in position at the front discharge end of a two-tiered track.
Figure 20:
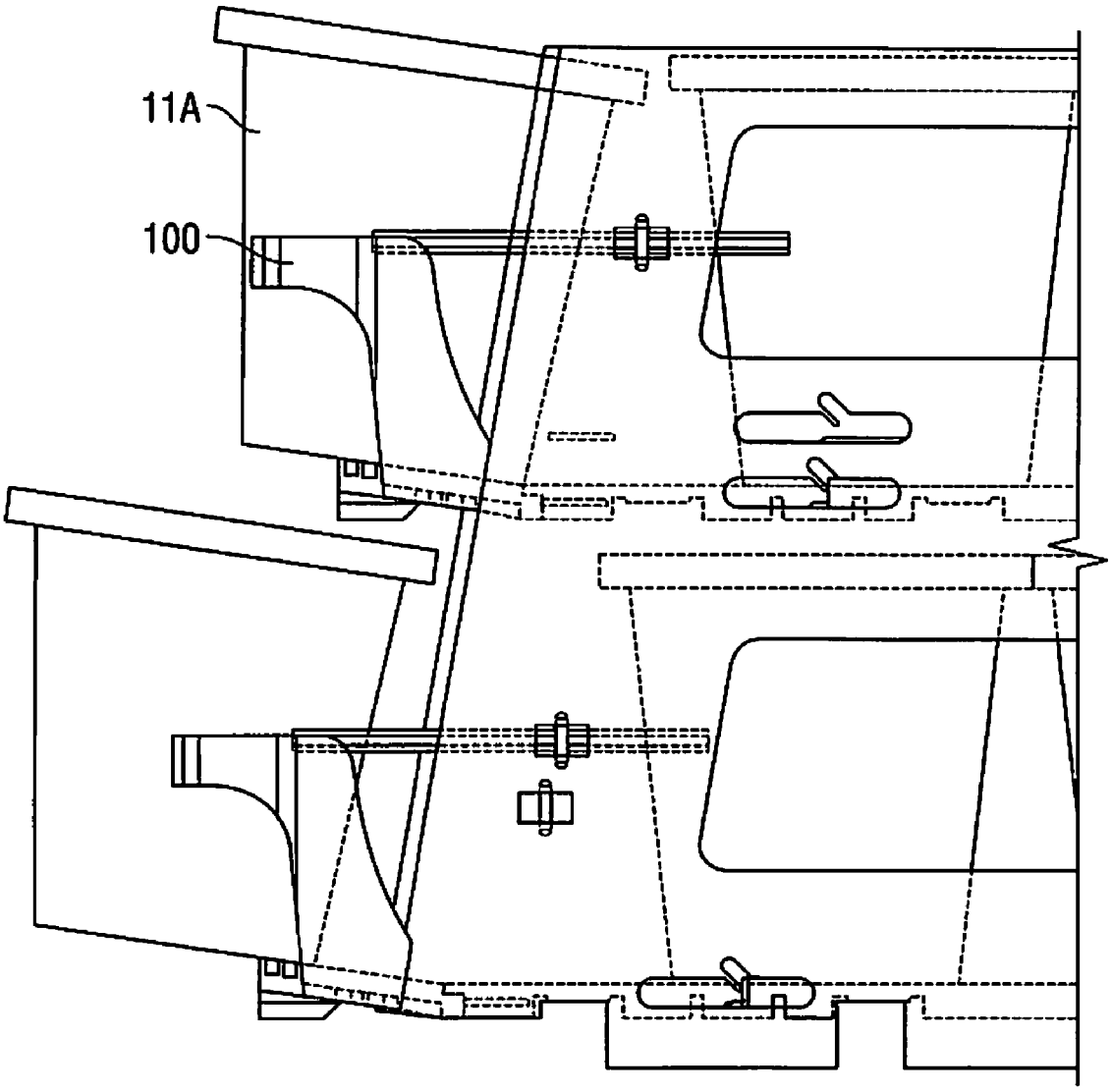
FIG. 20 is an enlarged side view of the dispenser track assembly showing the plurality of pull through fingers engaging a first article in each of the tracks.

As seen in FIGS. 14 and 16, the exit ramp 9 will tilt the lead container 51A forward slightly until stopped by fingers 16 (also called hoop 16) of fence 15. In this orientation the front surface of the lead container 51A and label thereon will be clearly visible, and the lead container 51A is easily removable by a customer who can grasp and lift the lead container 51A over fence 15, as further seen in FIG. 17. FIGS. 11 and 18 illustrate high and low versions 15, 15A respectively of the fence. The same reference numbers are used for the fingers 16, bracket 35 and mounting tabs 12 and 13. The differently shaped fingers on the two fences 15, 15A provide different areas of support for the lead container on the exit ramp.

Figure 15:
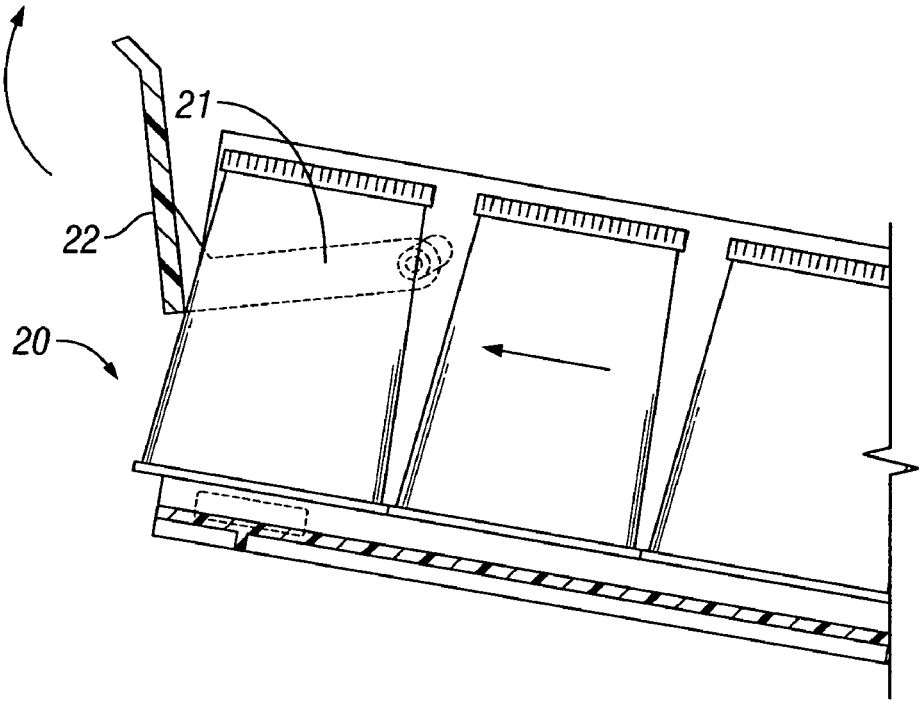
FIG. 15 is a fragmentary side elevation view taken along lines 15-15 in FIG. 12 and similar to FIG. 6, showing the rear restraining barrier in its up and fully pivoted state where it blocks the rear container from falling rearwardly off the track.

FIG. 15 illustrates the same back strap 20 seen in FIGS. 4-6, but here employed with the dispenser track assembly of FIG. 12 and containers of the type that are bell-shaped.

A further feature of the first embodiment, seen in FIG. 3, is a wave configuration 55 near the front discharge portion 2A, 3A of each of tracks 2, 3. These tracks have widths slightly greater than the diameter of the container 11 being dispensed. Wave configuration 55 extends for a distance equal to about three container diameters. More specifically, the top surface of track 2 is flat from its rear end forward until wave configuration 55 begins with a downward dip 56, which is followed by a rise or hill 57, which is followed by a dip 58, which is followed by the exit ramp 9. Dip, rise and dip each extend lengthwise a distance about equal to one diameter of container 11. Each of the containers 11 sliding on wave configuration 55 will alternately tilt forward when descending dips 56, 58, tilt backward when ascending rise 57, and tilt further backward (for an inverted bell-shaped container) upon ascending exit ramp 9. The wave configuration 55 can also be used on a track with bell-shaped containers 41. In this embodiment, exit ramp 9 will tilt the container 41 forward.

The purpose of the wave configuration 55 is to induce the container 11 nearing exit ramp 9 to tilt in a manner that will reduce the possibility of the edges of lids of adjacent containers from becoming partially jammed together. Such engagement of lid edges could create difficulty for a customer to remove the lead container or could cause a "traffic jam" of containers. Such jamming is not uncommon, as these containers slide downward on this gravity feed track and their cumulative weight bears on the forwardmost containers.

The above-described tracks and side walls are made of opaque molded polyethylene, and the front barrier fence or hoop is made of clear polycarbonate to avoid any obstacles to visibility of the front surface and label on the lead container. Many other common industrial plastics may be used.

FIGS. 19-24 illustrate features of another embodiment of the dispenser track assembly 1. As shown therein, pull through fingers 100 are provided to facilitate dispensing containers 11. Fingers 100 are dimensioned and configured to flexibly hold first container 11A in place and to flex open to dispense the container 11A without the need to lift the container 11A relative to track 110.

Figure 21:
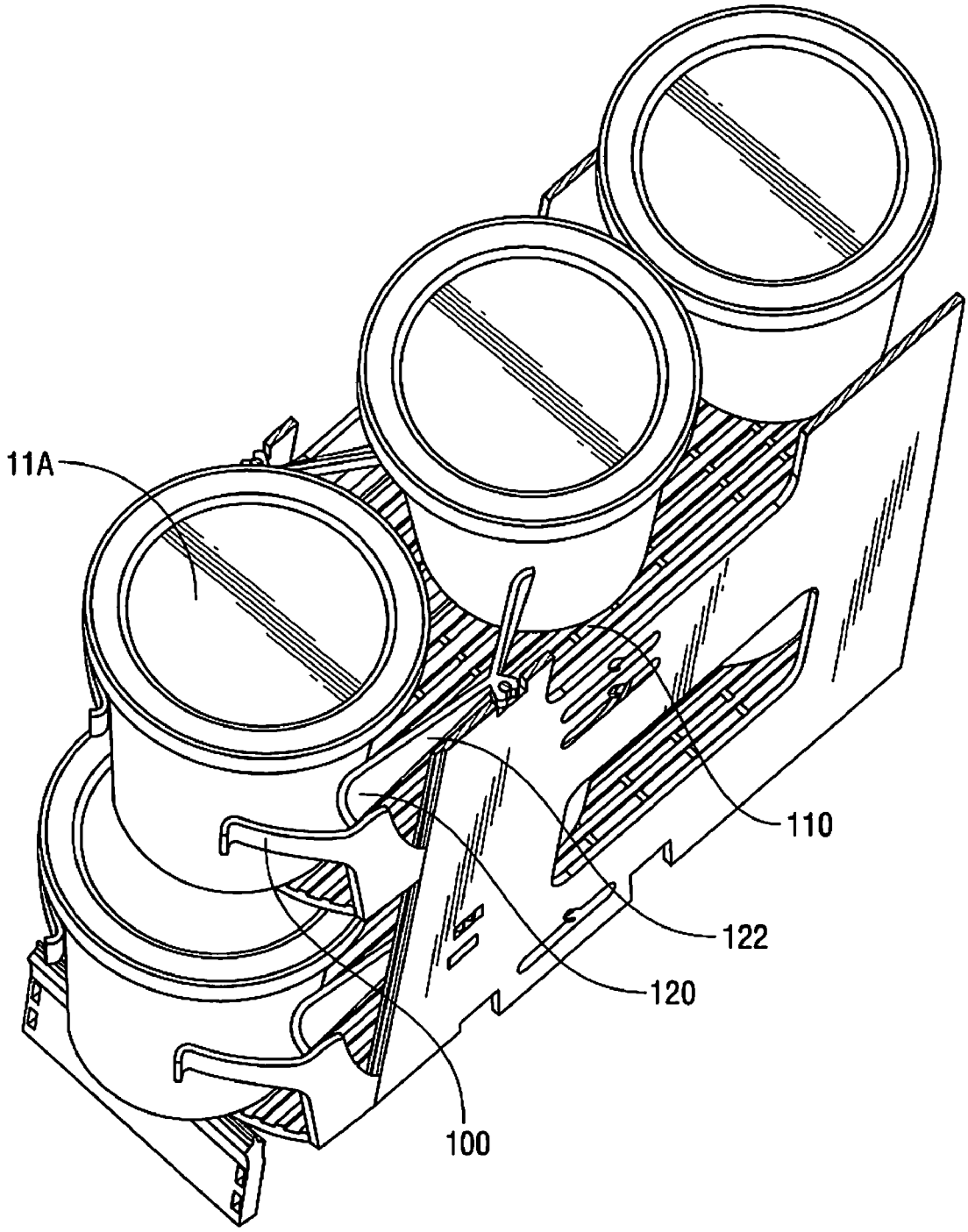
FIG. 21 is an enlarged top perspective view of the dispenser track assembly showing the plurality of pull through fingers in cooperation with flippers of a metering mechanism for refining extraction of the respective first article.
Figure 22:
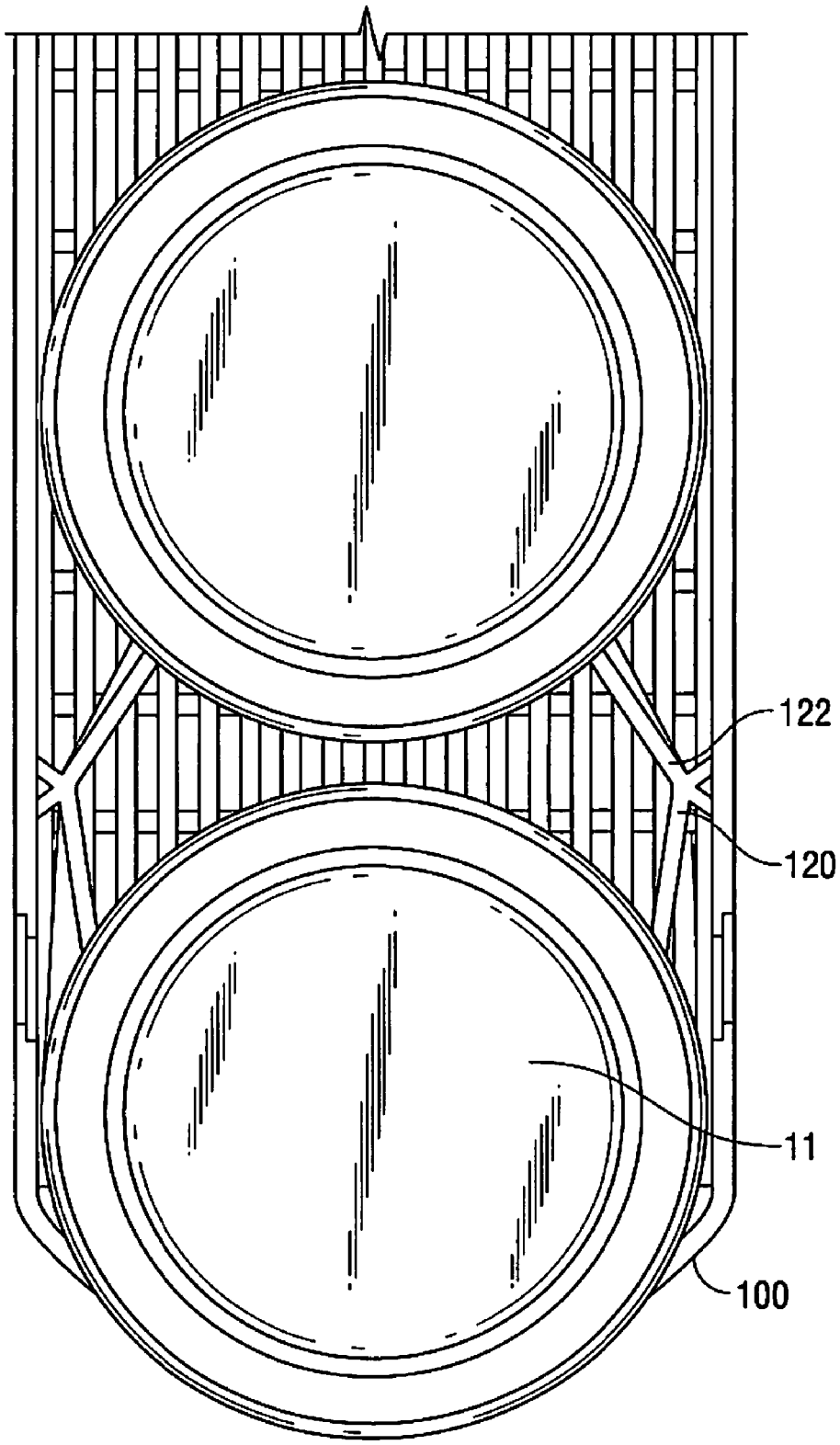
FIG. 22 is an enlarged top view of the dispenser showing pull through fingers and the flippers of the metering mechanism.

In addition, a metering mechanism 120 is shown in FIGS. 21 and 22 which precludes the dispensing of more than one container 11 at a time. The metering mechanism 120 in this embodiment is a set of flippers or pivoting fingers which allows only one container 11 at a time to reach the pull through front fingers 100. This configuration allows for a constant extraction force and further permits long rows of articles to be gravity fed, one at a time, into the shopping area.

Figure 23:
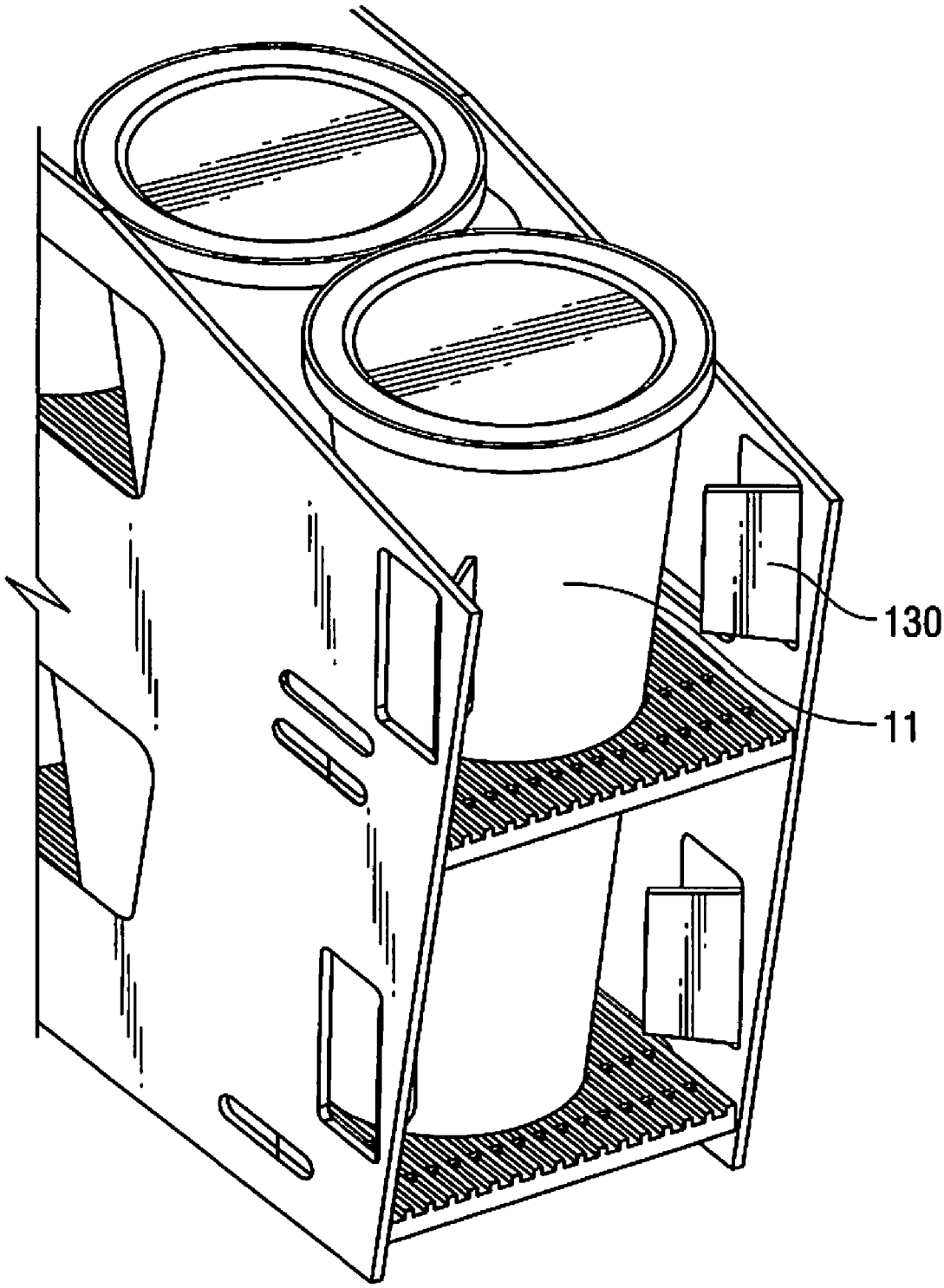
FIG. 23 is an enlarged rear perspective view of the dispenser track assembly showing a one-way rear gate in the form of a living hinge molded in place in the sidewall of the track.
Figure 24:
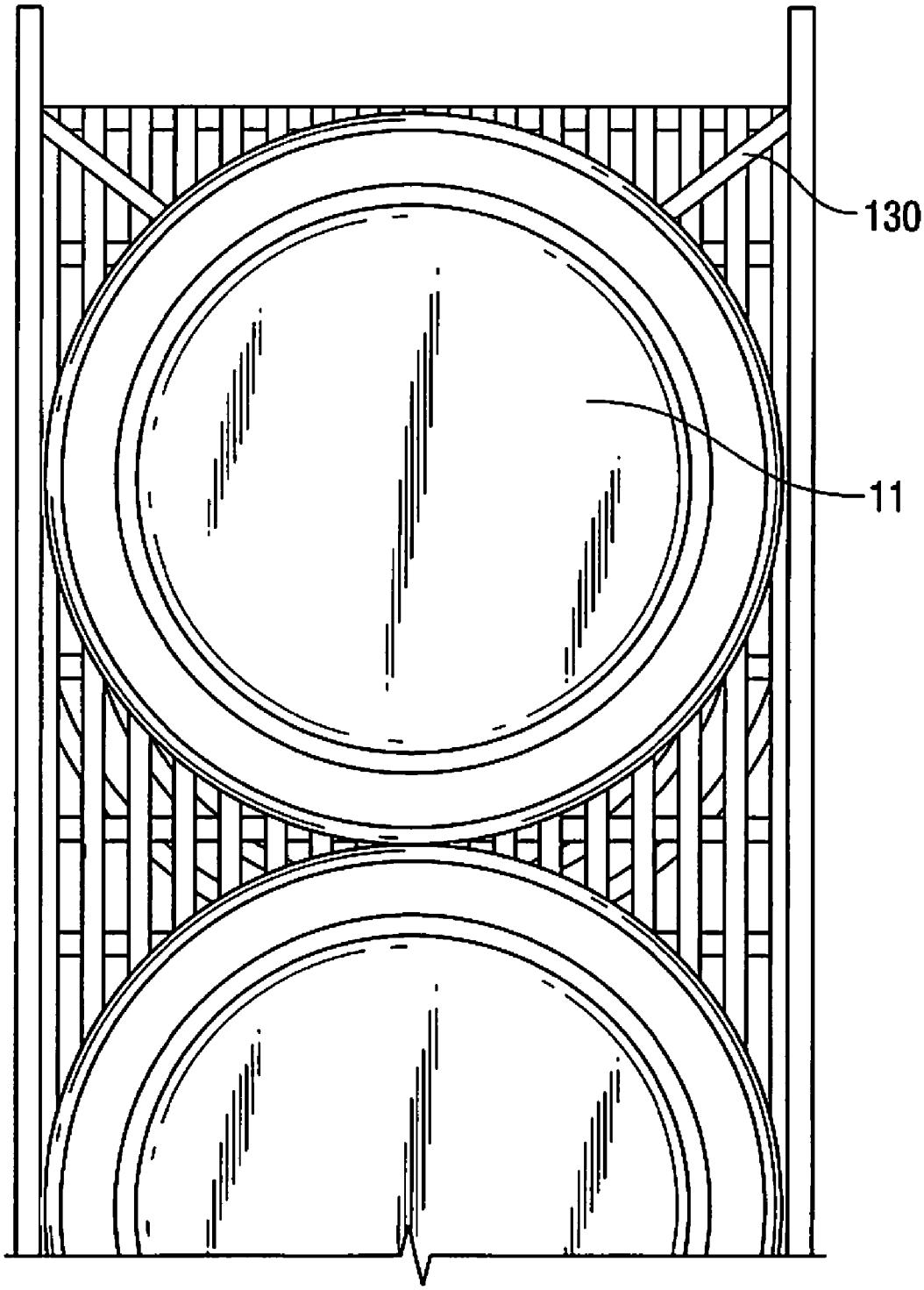
FIG. 24 is a top view of the rear end of the dispenser track assembly showing the one-way rear gate in position adjacent a rear-most article.

As shown in FIGS. 23 and 24, a novel one-way rear gate 130 is incorporated to prevent rear-most articles from falling out of the back of the dispenser track assembly 1 as the dispenser track assembly 1 is picked up or moved. In this embodiment, one-way rear gate 130 is a living hinge mechanism which, when engaged by an article 11 sliding rearwardly, will fold rearwardly over onto the wall and prevent the article 11 from falling off of the rear end of the track.

The present disclosure may be embodied in other specific forms without departing from the spirit or essential characteristics thereof. The present embodiments are therefore to be considered in all respects as illustrative and not restrictive, the scope of the disclosure being indicated by the appended claims rather than by the foregoing description, and all changes which come within the meaning and range of equivalency of the claims are therefore intended to be embraced therein. For example, in the embodiment having multiple tracks, it is envisioned for the exit ramps to tilt the articles at differing angles from one another. Each of the exit ramps can be angled to position its lead article such that the front surface of the lead article is angled toward a customer's eye level, thus enabling a customer (of average height) to view the front surface of the lead articles on all of the tracks. Further, it is envisioned for the angles of tilt on each exit ramp to be adjustable. It is also envisioned that fence is defined by a single finger extending from either side wall of track.

What is claimed is:

1. A dispenser track assembly adapted to hold a plurality of articles and to individually dispense each article, the dispenser track assembly comprising:

a track structure for holding a plurality of articles, the track structure including at least one track, each track having a rear portion, a front discharge portion, a bottom surface defining a generally flat plane and extending from the rear portion to the front portion and being downwardly sloped toward the front portion, the track structure being disposed between a first side wall and a second side wall;

an exit ramp for holding a lead article and for tilting the lead article relative to the bottom surface, said exit ramp being disposed adjacent the front discharge portion; and a pivotable rear restraining element disposed adjacent the rear portion, a barrier of the rear restraining element being parallel to the track and being adapted to prevent a distal-most article on the track from exiting the rear portion of track, wherein the rear restraining element is adapted to prevent the distal-most article from rearwardly exiting the track throughout the full range of motion of the rear restraining element, wherein the pivotable rear restraining element includes an arm being pivotably connected to at least one of the first side wall and the second side wall, wherein the barrier is attached to the arm, and wherein the arm includes a length such that the barrier rests against the bottom surface of the track.

2. The dispenser track assembly of claim 1 wherein the exit ramp is adapted to tilt a lead article rearward.

3. The dispenser track assembly of claim 1 wherein the track structure includes a plurality of tracks disposed between the first side wall and the second side wall.

4. The dispenser track assembly of claim 3 wherein the front portion of a lower track extends farther than the front portion of an upper track.

5. The dispenser track assembly of claim 3 further including a plurality track structures positioned adjacent one another.

6. The dispenser track assembly of claim 1 wherein the rear restraining element is adapted to allow an article to be inserted onto the track from-behind the track.

7. The dispenser track assembly of claim 1, wherein the pivotable rear restraining element includes a second arm pivotably connected to the other side wall, and wherein the barrier is attached to both arms such that the rear restraining element defines a U-shape.

8. A dispenser track assembly adapted to hold a plurality of articles and to individually dispense each article, the dispenser track assembly comprising:

a track for holding a plurality of articles, the track having a rear portion, a front discharge portion, a bottom surface defining a generally flat plane and extending from the rear portion to the front portion and being downwardly sloped toward the front portion, the track being disposed between a first side wall and a second side wall;

an exit ramp for holding a lead article and for tilting the lead article relative to the bottom surface, said exit ramp being disposed adjacent the front discharge portion; and a rear restraining element disposed adjacent rear portion for preventing an article on the track from exiting the rear portion of track, wherein the rear restraining element is positioned to allow an article to be inserted onto track from the rear portion;

wherein the rear restraining element includes a barrier and an arm, the arm being pivotably engaged with at least one side wall near the rear portion of the track, the barrier being attached to the arm, the arm including a length such that the barrier rests against the bottom surface of the track, said barrier being movable from a first position where said barrier rests on the bottom surface of the track, to a second position where at least a portion of the barrier is elevated from the track.

9. A dispenser track assembly adapted to hold a plurality of articles and to individually dispense each article, the dispenser track assembly comprising:

a track structure for holding a plurality of articles, the track structure including at least one track, each track having a rear portion, a front discharge portion, a bottom surface defining a generally flat plane and extending from the rear portion to the front portion and being downwardly sloped toward the front portion, the track structure being disposed between a first side wall and a second side wall;

an exit ramp for holding a lead article and for tilting the lead article relative to the bottom surface, said exit ramp being disposed adjacent the front discharge portion;

a fence disposed adjacent the front discharge portion of the track, said fence blocks the lead article from falling off the front discharge portion of the track and said fence being positioned to allow the lead article to be lifted over the fence and removed from the track, the fence including a pair of inwardly extending fingers defining a gap therebetween; and a pivotable rear restraining element disposed adjacent the rear portion of the track, a barrier of the rear restraining element being parallel to the bottom surface of the track and extending transversely across the bottom surface of the track, the barrier being biased against the bottom surface of the track in its normal condition, and the barrier being adapted to prevent a distal-most article on the track from exiting the rear portion of track, wherein the rear restraining element comprises an arm pivotably attached to at least one side wall, wherein the barrier is attached to the arm, and wherein the arm includes a length such that the barrier rests against the bottom surface of the track;

wherein the rear restraining element is adapted to prevent the distal-most article from rearwardly exiting the track throughout the full range of motion of the rear restraining element, and wherein the rear restraining element is adapted to allow a plurality of articles to be inserted onto the bottom surface of the track from-behind the track without the articles contacting the rear restraining element.

* * * * *